US009380861B1

(12) United States Patent
Newman

(10) Patent No.: US 9,380,861 B1
(45) Date of Patent: Jul. 5, 2016

(54) COLLAPSIBLE TABLE WITH AUGER ANCHORS

(71) Applicant: Chris Newman, Coldwater, MI (US)

(72) Inventor: Chris Newman, Coldwater, MI (US)

( * ) Notice: Subject to any disclaimer, the term of this patent is extended or adjusted under 35 U.S.C. 154(b) by 0 days.

(21) Appl. No.: 14/887,624

(22) Filed: Oct. 20, 2015

(51) Int. Cl.

| | |
|---|---|
| ***A47B 3/06*** | (2006.01) |
| ***A47B 37/04*** | (2006.01) |
| ***A47B 13/08*** | (2006.01) |
| ***A47B 13/00*** | (2006.01) |

(52) U.S. Cl.
CPC ..... *A47B 3/06* (2013.01); *A47B 13/003* (2013.01); *A47B 13/08* (2013.01); *A47B 37/04* (2013.01)

(58) Field of Classification Search
CPC ..... A47B 3/06; A47B 13/003; A47B 13/08; A47B 37/04
See application file for complete search history.

(56) References Cited

U.S. PATENT DOCUMENTS

| | | | | | |
|---|---|---|---|---|---|
| 1,554,609 | A * | 9/1925 | Watts | A47B 3/06 | 108/34 |
| 1,756,777 | A * | 4/1930 | Wright | A47B 3/06 | 108/26 |
| 2,905,513 | A | 9/1959 | Kane | | |
| 3,298,328 | A | 1/1967 | Hoodis | | |
| 4,563,040 | A * | 1/1986 | Alster | A47B 3/06 | 108/155 |
| 4,765,253 | A * | 8/1988 | Schappach | A47B 3/06 | 108/158.12 |
| 5,046,699 | A | 9/1991 | Perreault | | |
| D366,372 | S | 1/1996 | Skarda, Jr. | | |
| 5,638,762 | A * | 6/1997 | Chestnutt | A47B 13/003 | 108/158 |
| 5,678,892 | A * | 10/1997 | Heitlinger | A47B 9/00 | 248/188.5 |
| 5,762,004 | A | 6/1998 | Vashon | | |
| 5,941,183 | A * | 8/1999 | Ming-Shun | A47B 3/06 | 108/153.1 |
| 6,109,279 | A * | 8/2000 | Kloss | A47B 37/04 | 135/16 |
| 6,237,881 | B1 * | 5/2001 | Levesque | A47B 85/06 | 108/157.1 |
| 6,487,977 | B1 * | 12/2002 | Williams | A45B 23/00 | 108/150 |
| 6,827,028 | B1 * | 12/2004 | Callaway | A47B 3/06 | 108/157.1 |
| 7,007,703 | B2 | 3/2006 | Brooks, III | | |
| 9,215,923 | B1 * | 12/2015 | Boone | A47B 13/021 | |
| 2003/0205179 | A1 * | 11/2003 | Ilijas | A47B 3/06 | 108/157.16 |
| 2006/0228172 | A1 * | 10/2006 | Gillia | A47B 13/003 | 403/355 |
| 2007/0159781 | A1 * | 7/2007 | Zbikowskia | A45C 13/02 | 361/679.27 |
| 2007/0209561 | A1 * | 9/2007 | Hsieh | A47B 3/06 | 108/156 |
| 2008/0196636 | A1 * | 8/2008 | Lawrence | A47B 3/06 | 108/150 |
| 2010/0163086 | A1 * | 7/2010 | Chavez | A45B 3/00 | 135/16 |
| 2014/0102337 | A1 | 4/2014 | Ralph | | |
| 2014/0250593 | A1 * | 9/2014 | Kim | A47B 3/06 | 5/114 |
| 2015/0173504 | A1 * | 6/2015 | Price | A47B 3/06 | 108/185 |
| 2015/0320213 | A1 * | 11/2015 | Sorrell | A47B 91/16 | 108/27 |

FOREIGN PATENT DOCUMENTS

| | | | |
|---|---|---|---|
| CN | 201743236 | U | 2/2011 |

* cited by examiner

*Primary Examiner* — Hanh V Tran

(57) ABSTRACT

The collapsible table with auger anchors is a table adapted for use with a grills and a hibachi. The collapsible table with auger anchors is a metal table that is designed to be anchored into a lake or river bed. This allows the grill or hibachi to be placed on the table top of the collapsible table with auger anchors for use in the water at a safe distance from a boat. The collapsible table with auger anchors further comprises a table top, a plurality of legs, and a plurality of struts.

6 Claims, 5 Drawing Sheets

COLLAPSIBLE TABLE WITH AUGER ANCHORS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of horizontally supported planar surfaces that are detached from their support unit, more specifically, a collapsible table adapted for use in a lake or river bed.

Boating is a popular pastime throughout the United States and many people make boating a daylong event. A highlight of the day can often be having a meal on the boat. One drawback in preparing meals in a boat is that having a fire on a boat is potentially dangerous because, unlike fires on land, boaters generally cannot run away from a boat towards safety. Because of the potential fire hazard, many boaters do not use grills or hibachis on their boat.

SUMMARY OF INVENTION

The current disclosure addresses the above shortcoming.

The collapsible table with auger anchors is a table adapted for use with a grills and hibachis. The collapsible table with auger anchors is a metal table that is designed to be anchored into a lake or river bed. This allows the grill or hibachi to be placed on the table top of the collapsible table with auger anchors for use in the water at a safe distance from a boat.

These together with additional objects, features and advantages of the collapsible table with auger anchors will be readily apparent to those of ordinary skill in the art upon reading the following detailed description of the presently preferred, but nonetheless illustrative, embodiments when taken in conjunction with the accompanying drawings.

In this respect, before explaining the current embodiments of the collapsible table with auger anchors in detail, it is to be understood that the collapsible table with auger anchors is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the collapsible table with auger anchors.

It is therefore important that the claims be regarded as including such equivalent construction insofar as they do not depart from the spirit and scope of the collapsible table with auger anchors. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
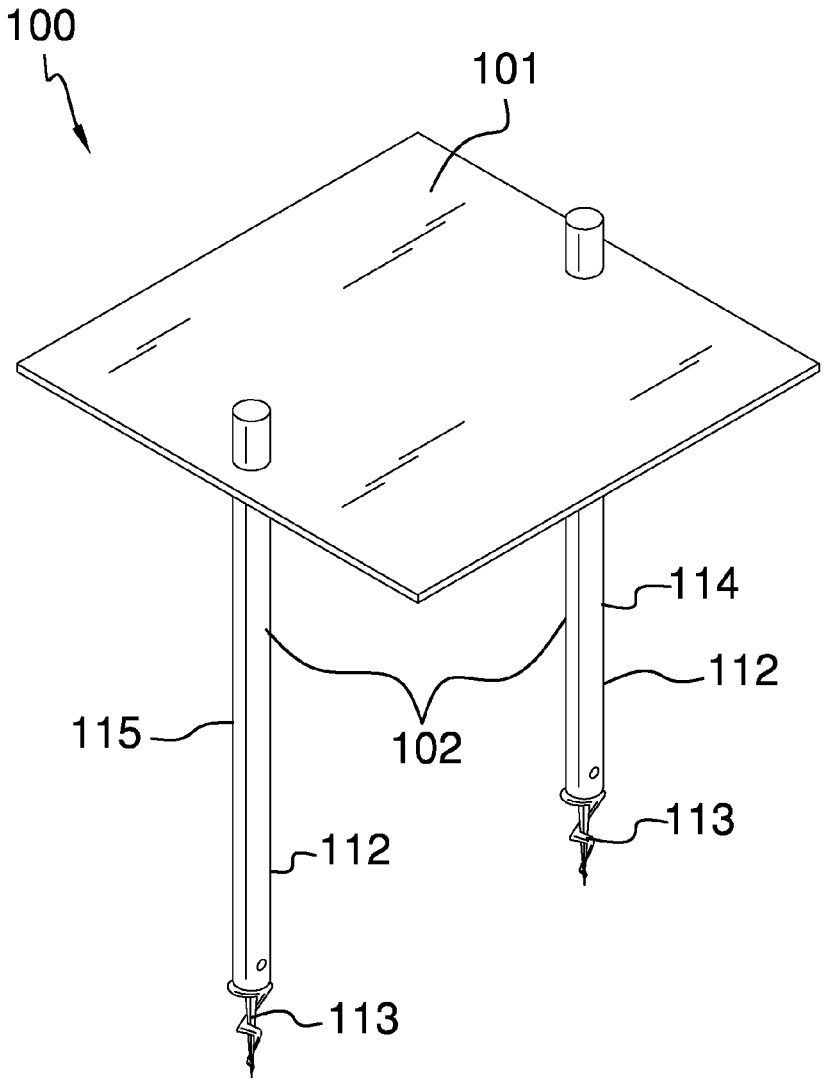
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 5. The collapsible table with auger anchors 100 (hereinafter invention) further comprises a table top 101, a plurality of legs 102, and a plurality of struts 103.

The table top 101 is a metal plate that forms the horizontal part of the invention 100 upon which the grill 133 is placed. The table top 101 further comprises a plurality of leg holes 111. Each of the plurality of leg holes 111 is formed through the surface of the metal plate. Each of the plurality of leg holes 111 is sized to receive a leg selected from the plurality of legs 102. The number of leg holes contained in the plurality of leg holes 111 formed into the table top 101 will be the same as the number of legs contained in the plurality of legs 102.

The plurality of legs 102 are used to raise the table top 101 above the water 131 and to support the table top 101 during use. Each of the plurality of legs 102 further comprises a shaft 112 and an auger 113. The shaft 112 is a hollow cylinder that is further defined with a first end 121 and a second end 122. The auger 113 is attached to the second end 122 of the shaft 112. The auger 113 screws into the lake or river bed 132 which anchors each of the plurality of legs 102 into the lake or river bed 132 during use. Approximately 4 to 10 cm from first end 121 of the shaft 112 towards the second end 122 of the shaft 112 are formed the first hole 123 and the second hole 124. The first hole 123 and the second hole 124 are both formed through the face of the hollow cylinder that forms the shaft 112. The first hole 123 and the second hole 124 are aligned such that when the shaft 112 rises perpendicularly out of the surface 134 of the water 131 then a line drawn from the center of the first hole 123 through the center of the second hole 124 will be parallel to the surface 134 of the water 131.

The first hole 123 and the second hole 124 are identical in size and are sized to receive a strut selected from the plurality of struts 103.

Figure 2:
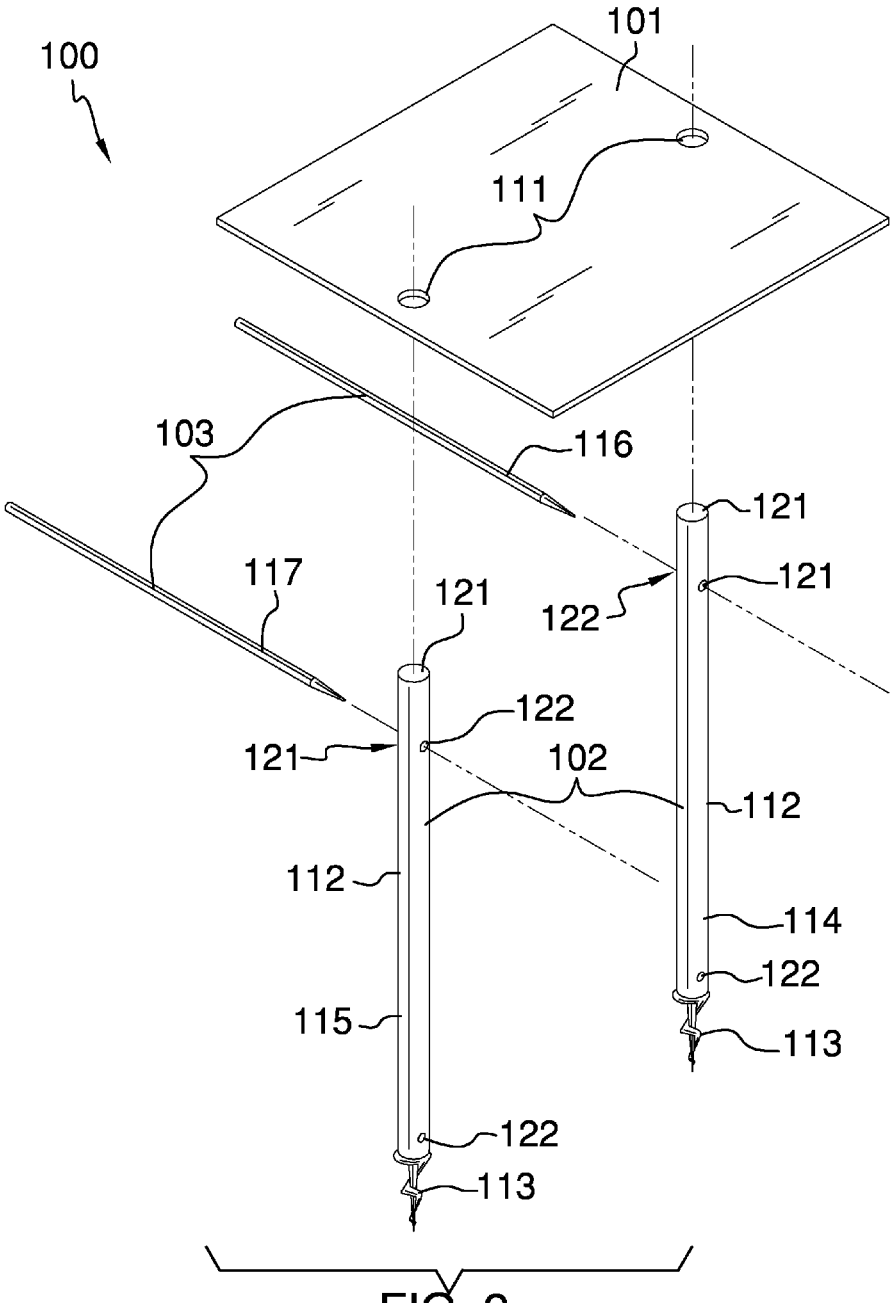
FIG. 2 is an exploded view of an embodiment of the disclosure.
Figure 3:
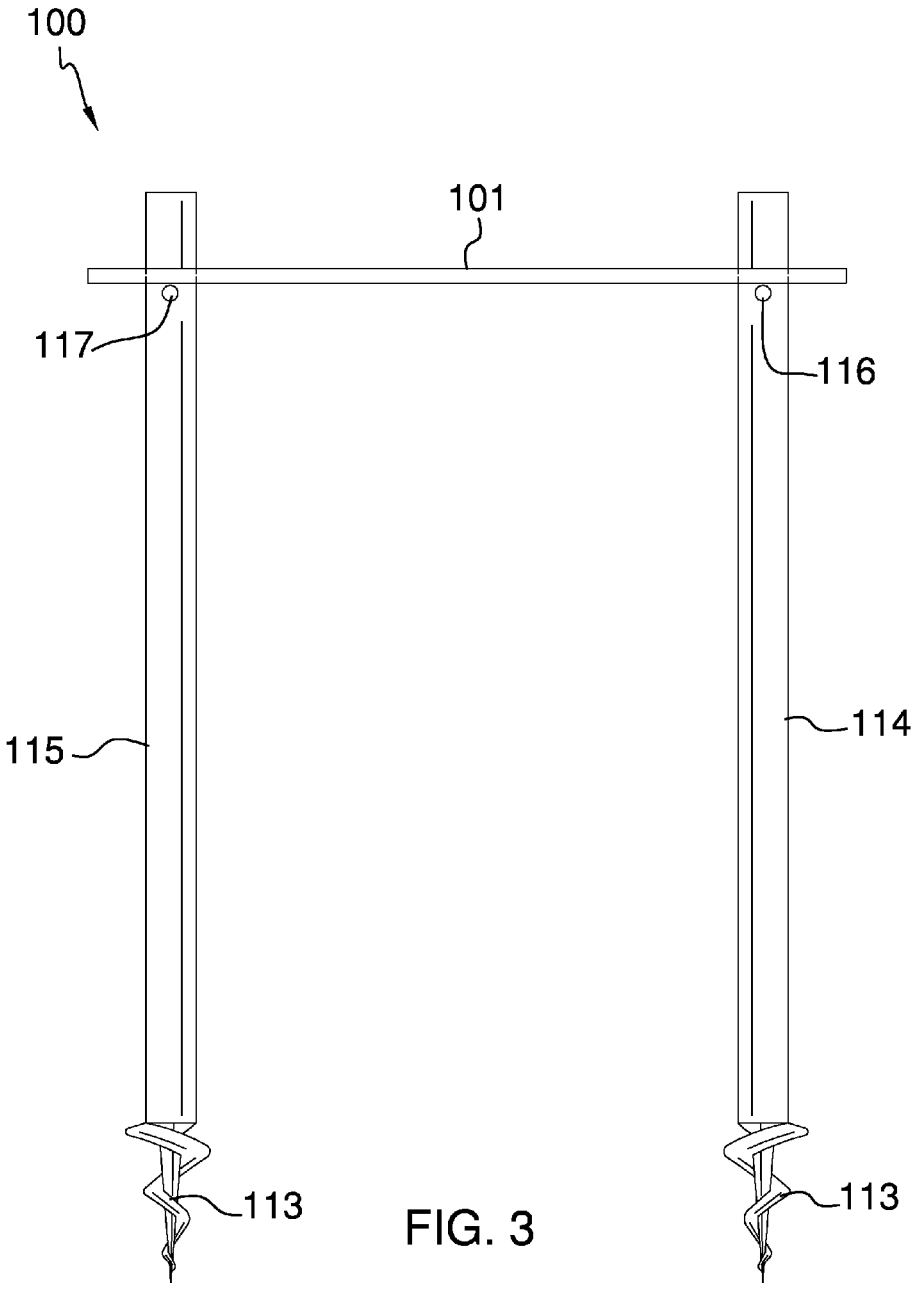
FIG. 3 is a side view of an embodiment of the disclosure.
Figure 4:
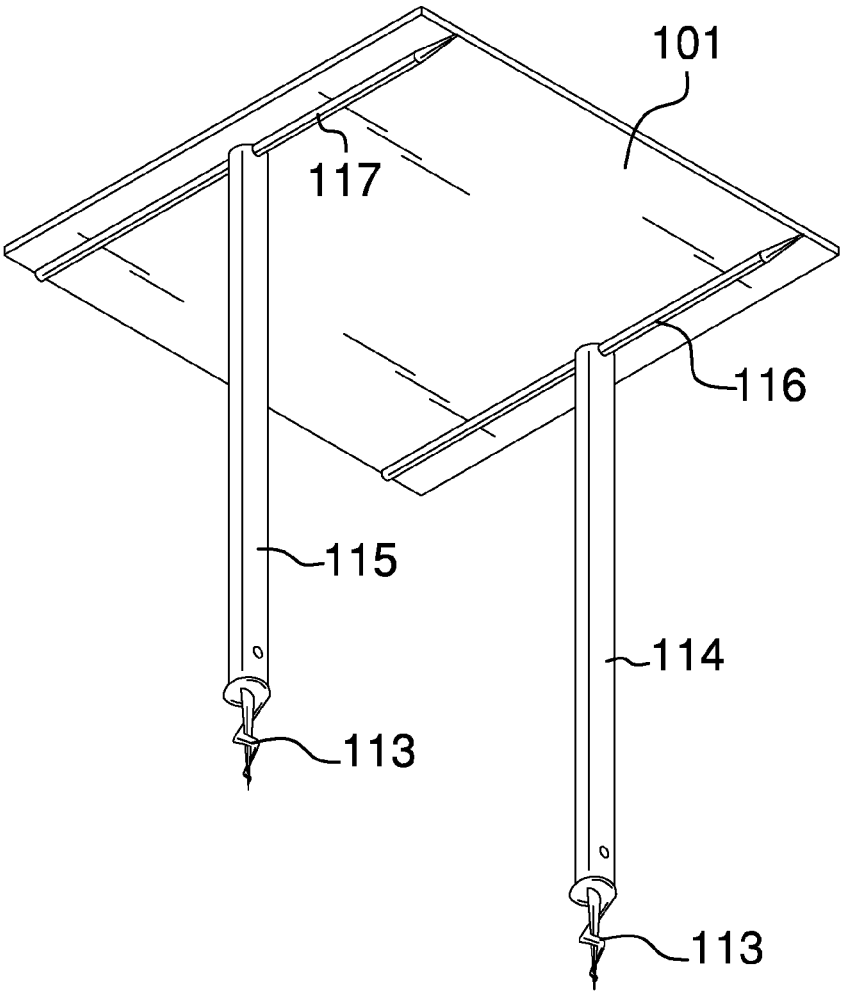
FIG. 4 is a bottom perspective view of an embodiment of the disclosure.
Figure 5:
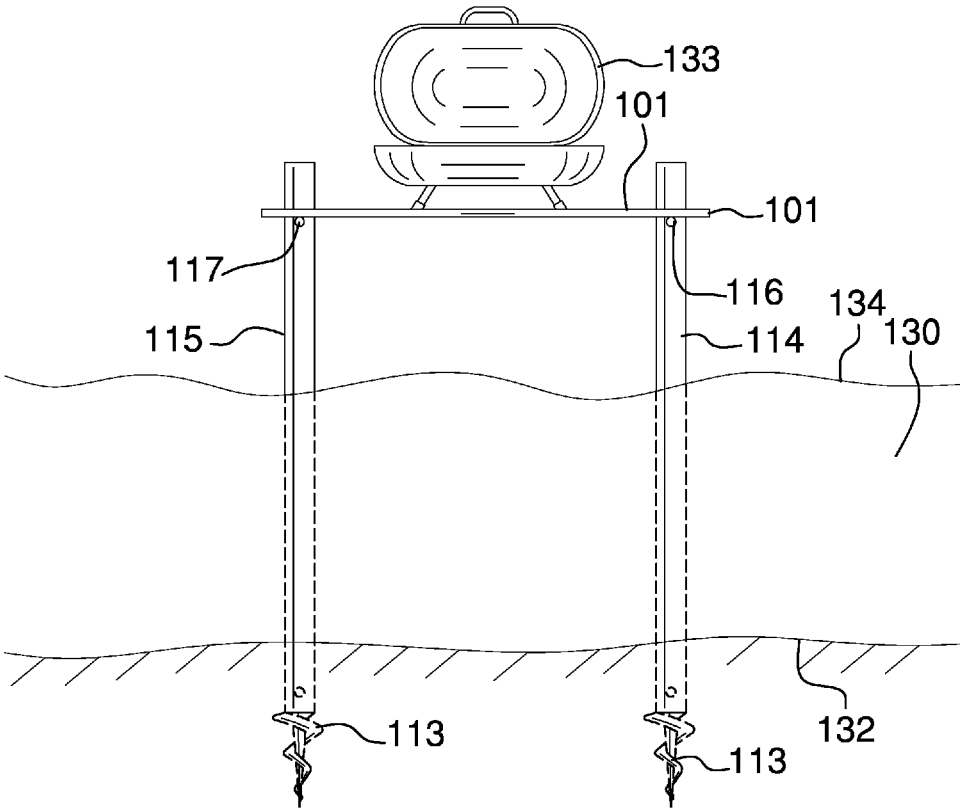
FIG. 5 is an in use view of an embodiment of the disclosure.

Each of the plurality of struts 103 are used to provide horizontal support for the table top 101. Each of the plurality of struts 103 are metal shafts that are sized to fit through the first hole 123 and the second hole 124. When a leg selected from the plurality of legs 102 is anchored into the lake or river bed 132, a strut is selected from the plurality of struts 103 and is inserted through the first hole 123 and the second hole 124 of the leg selected from the plurality of legs 102. As shown in FIGS. 2 and 4, once at least two struts selected from the plurality of struts 103 and two legs from the plurality of legs 102 are positioned in this manner, the plurality of struts 103 can be used to support the table top 101.

In the first potential embodiment of the disclosure, as shown in FIGS. 1 through 5, the table top 101, each of the plurality of legs 102, and each of the plurality of struts 103 are made from aluminum. The plurality of legs 102 further comprise a first leg 114 and a second leg 115. The plurality of struts 103 further comprises a first strut 116 and a second strut 117.

To assemble the first potential embodiment of the disclosure for use, the first leg 114 is screwed into the lake or river bed 132. The second leg 115 is screwed into the lake or river bed 132 such that the first hole 123 and second hole 124 of the first leg 114 are level with the first hole 123 and second hole 124 of the second leg 115. The first strut 116 is inserted through the first hole 123 and the second hole 124 of the first leg 114. The second strut 117 is inserted through the first hole 123 and the second hole 124 of the second leg 115.

The following definitions were used in this disclosure:

Auger: As used in this disclosure, an auger is a tool with a helical or screw type bit that is used for boring holes in objects.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; or, 4) the point, pivot, or axis around which something revolves.

Grill: As used in this disclosure, a grill is a metal structure that is used for cooking food over an open flame or burning charcoal. While there are structural differences, in this disclosure, the term hibachi is a synonym for grill.

With respect to the above description, it is to be realized that the optimum dimensional relationship for the various components of the invention described above in the FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A table comprising:

a table top, a plurality of legs, and a plurality of struts;

wherein the table is collapsible;

wherein the table is adapted for use in a lake or river bed;

wherein the table is anchored to the lake or river bed with augers wherein the plurality of legs are used to raise the table top above the surface of the water contained in the lake or river bed;

wherein the table top further comprises a plurality of leg holes;

wherein each of the plurality of leg holes is sized to receive a leg selected from the plurality of legs;

wherein the number of leg holes contained in the plurality of leg holes formed into the table top will be the same as the number of legs contained in the plurality of legs;

wherein each of the plurality of legs further comprises a shaft and an auger;

wherein the shaft is a hollow cylinder that is further defined with a first end and a second end;

wherein the auger is attached to the second end of the shaft;

wherein the plurality of legs further comprises a first leg and a second leg;

wherein the plurality of struts further comprises a first strut and a second strut;

wherein the first leg further comprises a first shaft and a first auger;

wherein the second leg further comprises a second shaft and a second auger;

wherein the first shaft further comprises a first hole and a second hole formed in the face of the first shaft;

wherein the second shaft further comprises a third hole and a fourth hole formed in the face of the second shaft;

wherein the first hole and the second hole are aligned such that when the shaft rises perpendicularly out of the surface of the water then a line drawn from the center of the first hole through the center of the second hole will be parallel to the surface of the water;

wherein the third hole and the fourth hole are aligned such that when the shaft rises perpendicularly out of the surface of the water then a line drawn from the center of the third hole through the center of the fourth hole will be parallel to the surface of the water.

2. The table according to claim 1 wherein the table top is a metal plate.

3. The table according to claim 1 wherein the first hole and the second hole are sized to receive the first strut;

wherein the third hole and the fourth hole are sized to receive the second strut.

4. The table according to claim 3 wherein each of the plurality of struts are metal shafts.

5. The table according to claim 4 wherein the table top is a metal plate;

wherein said plurality of leg holes comprise a first leg hole and a second leg hole;

wherein the first leg hole is sized to receive the first leg;

wherein the second leg hole is sized to receive the second leg.

6. The table according to claim 5 wherein the table top is supported by the first strut and the second strut.

* * * * *